United States Patent [19]

Remaks

[11] Patent Number: 4,706,850

[45] Date of Patent: Nov. 17, 1987

[54] DRAIN FITMENT FOR BULK CONTAINERS

[75] Inventor: William J. Remaks, Anchorage, Ky.

[73] Assignee: Weyerhaeuser Company, Tacoma, Wash.

[21] Appl. No.: 887,027

[22] Filed: Jul. 17, 1986

[51] Int. Cl.[4] ..... B65D 35/56

[52] U.S. Cl. ..... 222/105; 222/501; 222/520; 251/291

[58] Field of Search ..... 222/80–81, 222/105, 501, 507, 519, 520, 526, 532, 544–545, 548–549, 551–552, 567; 141/326–327, 348–349; 138/89, 92, 94; 220/260, 284; 251/291, 349

[56] References Cited

U.S. PATENT DOCUMENTS

| | | | |
|---|---|---|---|
| 495,718 | 4/1893 | Beebe | 137/319 |
| 1,554,410 | 9/1925 | Cooke | 222/552 X |
| 2,841,314 | 7/1958 | Munson et al. | 222/519 |
| 3,206,075 | 9/1965 | Scholle | 222/105 |
| 3,918,474 | 11/1975 | Supancic, Jr. | 141/349 X |
| 4,445,551 | 5/1984 | Bond et al. | 141/349 |

FOREIGN PATENT DOCUMENTS

| | | | |
|---|---|---|---|
| 151220 | 9/1920 | United Kingdom | 137/319 |

*Primary Examiner*—Joseph J. Rolla
*Assistant Examiner*—Michael S. Huppert
*Attorney, Agent, or Firm*—Angelo Notaro

[57] ABSTRACT

An improved push/turn tap and drain spout fitment for a multi-wall fiberboard container with a plastic retainer for retaining bulk flowable materials including a polygonal flange mounted within a similarly shaped opening in the fiberboard. A valve tube extendable through a spout assembly. The valve tube includes prongs for engaging a bung which is threadably connected to the spout assembly to seal an opening in the plastic retainer. The valve tube, though sealingly coupled to the spout assembly, can be moveably manipulated from the outside of the container to cause the bung to become disengaged from the spout assembly.

13 Claims, 7 Drawing Figures

DRAIN FITMENT FOR BULK CONTAINERS

BACKGROUND OF THE INVENTION

This invention relates to fitments for bulk containers and, more particularly, to a push/turn tap and drain spout fitment assembly for gravity discharge of bag-in-box bulk containers, wherein a fitment is connected to a plastic bag or liner supported within a multi-wall fibreboard sleeve of a bulk container intended for use as a heavy-duty shipping container for liquids or dry flowable products, particularly those that require evacuation of the contained product by gravity flow, and whose structure, size, or weight do not readily allow for tipping on their side to allow for initiation of product flow.

The term "bulk container" as used herein denotes a multi-wall fibreboard shipping container for flowable substances and, more particularly, a heavy-duty shipping container for the bulk transport of flowable bulk materials, including liquids, dry powders or granular substances, semi-solid materials such as grease, pastes or adhesives and, as well, highly viscous fluids, generally contained within a plastic bag or liner supported within the container, in volumes of at least fifty-five gallons (approximately two hundred ten liters) and in quantities of weight greater than four hundred-fifty pounds (approximately two hundred kilograms).

Bag-in-box packaging has been widely accepted as containers for flowables. Such packaging combines the advantages of the retention capabilities of plastic bags or liners with the strength of an outer fibreboard box or sleeve. Requirements for bulk containers having an inner plastic bag or liner are more stringent with respect to drain devices because of the high load and stresses to which the devices, and the joints between the drain devices and the fibreboard container or plastic, or both, will be subjected, as well as the potential for leakage in the event of failure of such components.

Gravity flow spout devices located at the bottom of fibreboard bulk containers for flowables have traditionally been shipped with a discharge valve attached thereto, or provided with a sealing membrane covering the fitment opening that is designed to be pierced or torn by a puncturing device, or, as commonly seen in use with cooling radiators, provided with a threaded drain sealing plug which, when screwed inwardly, expose slots within an outer housing to allow escape of the contained coolant.

Several disadvantages are associated with use of each of the aforementioned gravity drain devices. A shipping container having a valve attached thereto, for example, is costly and also exposes the valve to transit damage and, as well, to tampering. Membrane style fitments, on the other hand, are subject to leakage, particularly when used in connection with shipping containers which carry heavy bulk loads and wherein the membrane will be subject to significant, cyclic forces during transit and static wall stresses as where such containers are stacked. Additionally, there is a chance that pieces or fragments of the membrane material will be forced into the outlet, as the liquid begins to drain, causing either a partial blockage of the outlet or dislodging, and thus contaminating the product being emptied. Radiator style plugs and spouts also disadvantageously protrude well beyond the plane of the outer surface of the container and are thus subject to transit damage. In addition, radiator style plugs and spouts are subject to tampering, and are cumbersome to use with certain types of containers, particularly containers used in conjunction with flexible liner bags, in which case the drain spout fitment must be attached and sealed to the liner bag prior to filling. Additionally, radiator type plugs tend to allow for a limited cross-sectional flow area, thus restricting the flow, and this is particularly disadvantageous with respect to withdrawal of viscous products from a container.

SUMMARY OF THE INVENTION

An improved push/turn tap and drain spout fitment assembly is provided for gravity discharge of a bulk container in which the fitment is connected to a plastic bag supported within a rigid, multi-wall fibreboard container. The fitment includes a drain spout assembly an annular flange which is sealingly engaged about an aperture formed in the plastic bag, an integral polygonal shoulder flange seated within a polygonal opening extending through the fibreboard wall of the container and a spout extending from the container. The spout includes a threaded outer portion held in place by a nut engaged to the outer threads and which is torqued against the outer wall of the container. However, part of the threaded portion extends outwardly of the container beyond the nut.

The outer end of the spout portion is closed by a conventional bung prior to use. In operation, the outer bung is removed and the extended threaded portion is engaged by a coupler. The coupler is a cylindrical member and includes an O-ring seal. A tube, referred to as a valve tube, is inserted into the coupler and the O-ring seal and then partially pushed into the spout.

The end of the valve tube which is designed to extend inwardly of the container is provided with longitudinal prongs at circumferentially-spaced intervals. An inner bung is mounted to the inner side of the spout and has complementary recesses designed to receive the prongs. Thus, the valve tube is pushed into the spout so that the prongs axially extend into the recesses of the inner bung. Rotation of the valve tube forces the inner bung to unseat and be pushed into the container. The spaces between the prongs allow fluid pressure on each side of the inner bung to quickly equalize. A valve is mounted to the outer end of the valve tube so that fluid discharge can be control- led.

BRIEF DESCRIPTION OF THE DRAWINGS

In the accompanying drawings, forming a part of this specification, and in which reference numerals shown in the drawings designate like or corresponding parts throughout the same.

DETAILED DESCRIPTION

Figure 1:
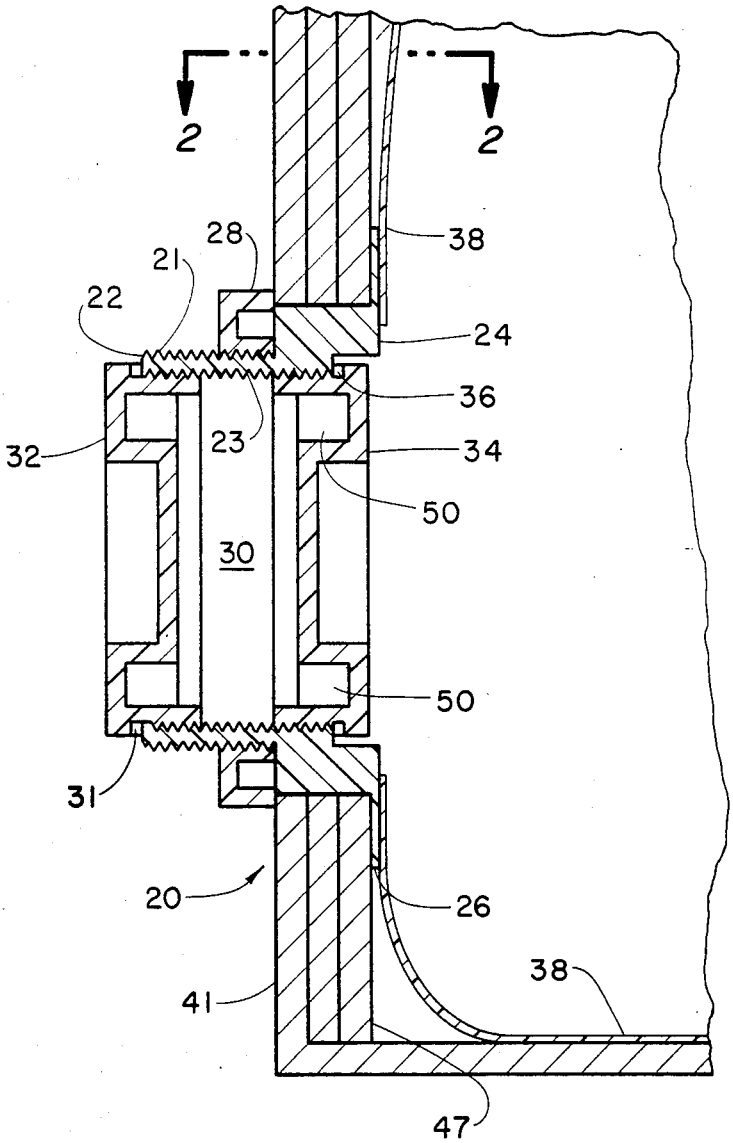
FIG. 1 is a side cross-sectional view of a plugged drain spout assembly mounted to a fibreboard container, shown in part, prior to final assembly of the fitment.

FIG. 1 illustrates a drain spout assembly, in a closed condition, mounted to a fibreboard container 20. The drain spout assembly includes a tubular spout 22, projecting outwardly of the container 20, and connected to a hexagonal flange 24, seated within a shell or wall opening 25 (see FIG. 7) extending through the wall of the container 20, and which, in turn, is connected to an annular flange 26 located within the container surrounding the opening 25. The annular flange 26 is abutted against the inner wall surface 47 of the container 20. The tubular spout 22, the hexagonal flange 24 and the annular flange 26 are preferably plastic and comprise a unitary assembly.

Threads 21, 23 are formed on both external and internal surfaces of the tubular spout 22 and on the internal surface of at least part of the hexagonal flange 24. A nut 28 is threadably engaged to the outer threads 21 of the spout 22 in torqued engagement and abutment against the outer wall surface 41 of the container 20 and the hexagonal flange 24. The tubular spout 22 projects outwardly of the container 20 beyond nut 28.

The drain spout assembly is provided with a bore 30 extending therethrough. The opposite ends of the bore 30, as illustrated in FIG. 1, are closed by bungs 32, 34 which are threadably engaged to the inner threads 23 of the spout 22 and the hexagonal flange 24, respectively. An elastomeric seal 36, such as a rubber O-ring, is provided to further seal the threaded interface between bung the 34 and the hexagonal flange 24. A similar seal 31 is provided between the threaded interface of the bung 32 and spout 22.

A plastic bag 38 is sealingly secured to the annular flange 26 preferably on the side of the bag adjacent to the inner wall surface 47 of the container 20. The annular flange 26 extends about the periphery of a drain opening 39 (see FIG. 7) that passes through the bag 38. The drain opening 39 and the shell opening 25 are aligned in registry with each other to allow passage of the tubular spout 22 therethrough during assembly of the drain spout assembly to the container 20.

Figure 2:
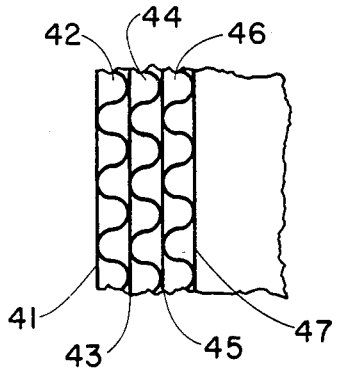
FIG. 2 is a partial sectional view taken along line 2—2 of FIG. 1.
Figure 6:
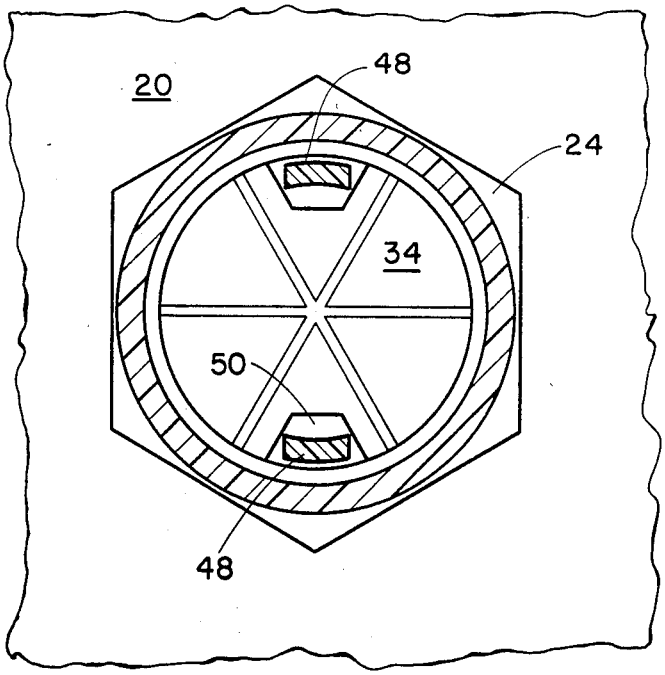
FIG. 6 is a sectional view taken along view line 6—6 of FIG. 4.

As shown in FIGS. 1 and 2, the container 20 preferably has a side wall made of triple-wall corrugated fibreboard. The triple-wall corrugated fibreboard comprises three corrugated sheets 42, 44, 46 and four spaced liner sheets 41, 43, 45, 47 of containerboard, one each of the corrugated sheets being interposed between a different pair of liner sheets and adhesively engaged thereto in a well known manner. A single-wall corrugated fibreboard bottom flap (see FIG. 1) is employed in some preferred embodiments of a container including the drain spout fitment assembly. The outermost liner sheets function as the outer and inner wall surface 41, 47, respectively, of the side wall of the container 20. The length of the hexagonal flange 24 is preferably not greater than the wall thickness of the container 20 and the hexagonal flange does not extend beyond the respective outer and inner surfaces 41, 47 of the container. The shell opening 25 formed through the multi-wall fibreboard side wall of the container 20 has a hexagonal cross-section, as shown in FIG. 6, complementary to the cross-section of the hexagonal flange 24. Hexagonal flange 24 is closely received and tightly fitted against the fibreboard edges of the side wall which defines the periphery of the shell opening 25. The close fit between the hexagonal flange 24 and the wall surrounding the opening 25 prevents damaging rotation of the drain spout assembly relative to the bag 38 which could otherwise occur as the nut 28 and coupler 52 are connected to tubular spout 22, or when on assembly of the drain spout fitment, as described hereafter.

The plastic bag 38 may be filled with a fluid or solid or semi-solid flowables with the bungs 32, 34, in place, as shown in FIG. 1. In order to withdraw the flowables from the container 20, it is necessary to complete the assembly of the drain spout fitment.

Outer bung 32 is first unscrewed from the tubular spout 22 and discarded or saved for subsequent use.

Figure 3:
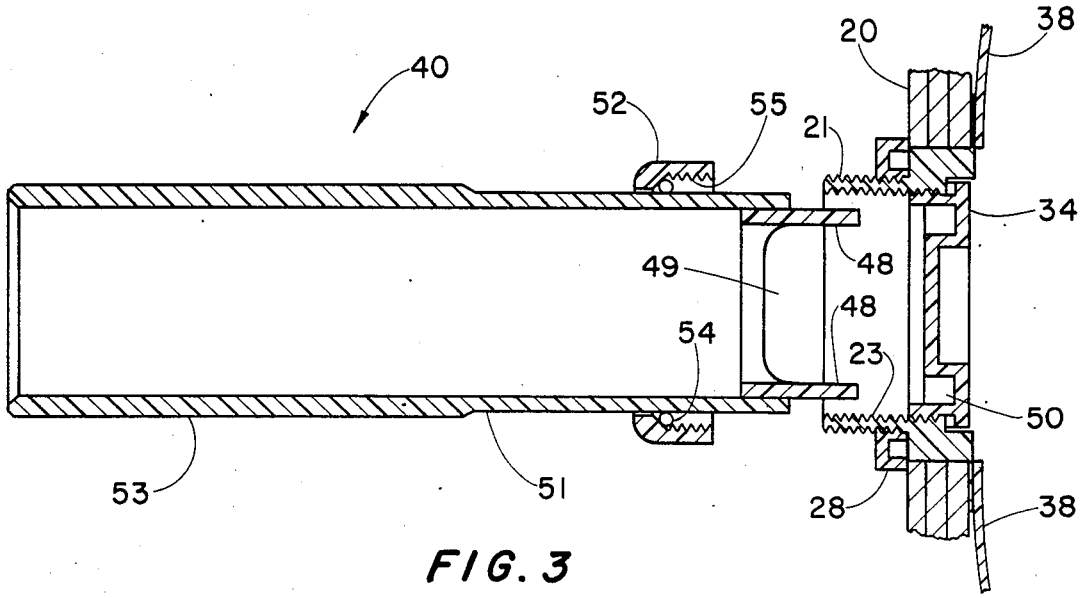
FIG. 3 is a partially-exploded, sectional view of a drain fitment according to the invention.

A valve tube 40 is then aligned with the bore 30 of the drain fitment assembly as shown in FIG. 3.

The valve tube 40 is provided with at least two peripherally spaced prongs 48 at the end of the valve tube adjacent the container 20. The prongs 48 are designed to be closely received within recesses 50 formed within the bung 34.

The outer surface of the valve tube 40 is stepped so that the tube has a smaller diametrical outer surface 51 located adjacent the container 20 and a larger diametrical surface 53 as shown in FIG. 3 . A coupler 52 is moveably mounted on the diametrical outer surface 51. The coupler 52 has an internally threaded portion 55 designed to be threadably engaged with the outer threads 21 of the tubular spout 22. An O-ring 54, or other suitable seal, is provided between the coupler 52 and the outer surface 51 to further seal the threaded interface between the coupler 52 and the tubular spout 22.

Figure 4:
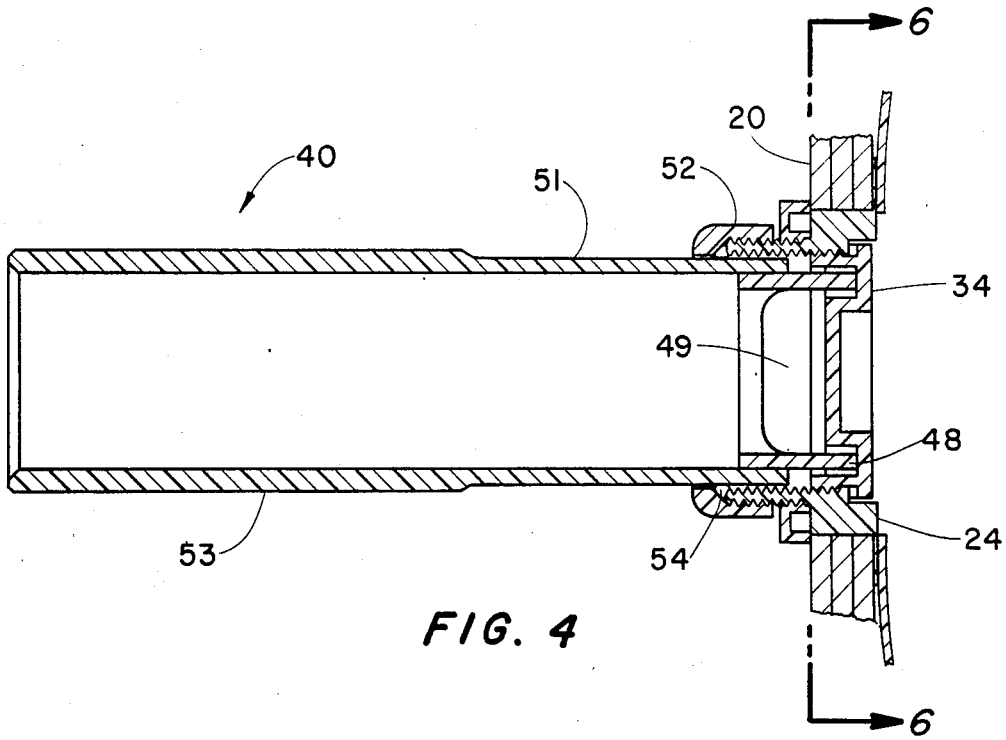
FIG. 4 is a sectional view of a partially-assembled drain fitment according to the invention.

The valve tube 40 is longitudinally inserted into the bore 30 so that the prongs 48 project into and are closely received within the recesses 50. The coupler 52 is then screwed to the tubular spout 22 until it abuts against the nut 28 as shown in FIG. 4. The resulting compression of the O-ring 54 between the coupler 52 and tubular spout 22 also tends to radially expand the O-ring 54, relative to the longitudinal axis of the valve tube 40, and thereby frictionally engage the coupler 52 and tubular spout 22 with the valve tube 40 so as to prevent leakage and, as well, to impede axial movement of the valve tube 40.

A conventional structure for closing the valve tube such as a closed valve (not shown), for example, a ball valve, may be engaged to the free end of the larger diametrical outer surface 53 by threaded connection or alternative, known engagement means.

The prongs 48 extending from valve tube 40 are separated from each other at circumferentially spaced intervals separated by spaces 49.

Figure 5:
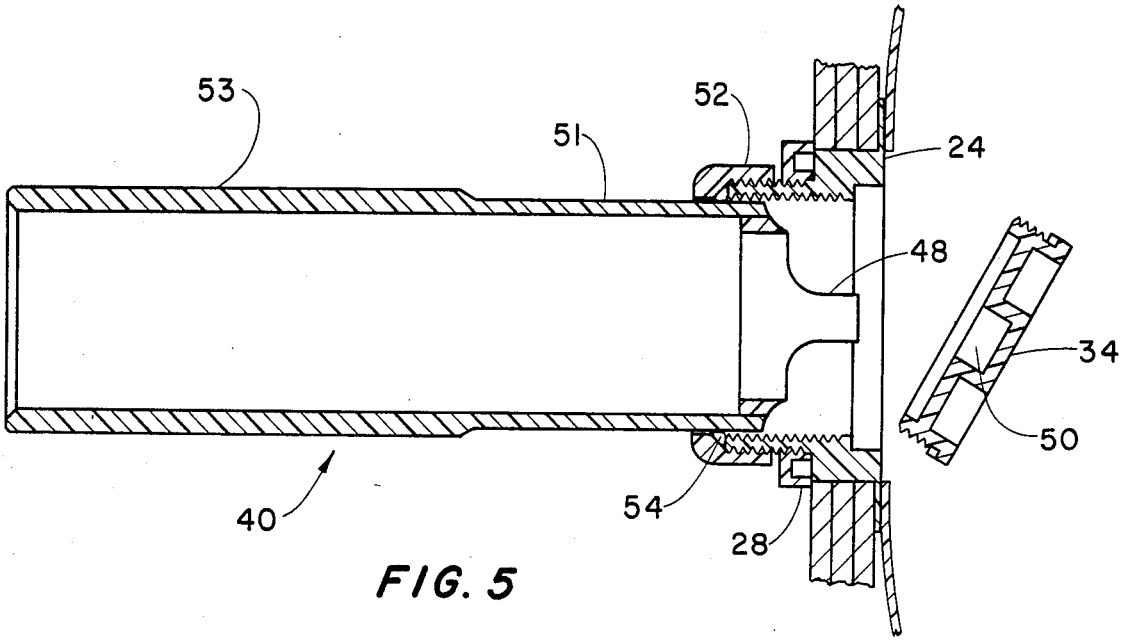
FIG. 5 is a sectional view of an assembled drain fitment according to the invention with the valve tube rotated by ninety-degrees relative to the illustration of FIG. 4.

In order to allow the contents of the container to be withdrawn, the inner bung 34 must be removed. In accordance with the invention, the valve tube 40 is rotated, as shown in FIG. 5, to unscrew the bung 34 from the inner thread 23 of the tubular spout 22 or hexagonal flange 24, or both. The bung 34 is pushed to the right in FIG. 5 into the container 20 and thereby positively unseated from the drain spout assembly.

As the interior bung 34 is loosened, flowables seep into the valve tube thereby equalizing the pressure on each side of the bung 34 in order to facilitate the turning and pushing movements of the bung 34 into the container 20 and away from the drain spout fitment. Even if the bung fails to fall away from the drain spout, the spaces 49 cut into the end of the valve tube, adjacent to the prongs 48, nevertheless allow outflow of the contained fluid.

Figure 7:
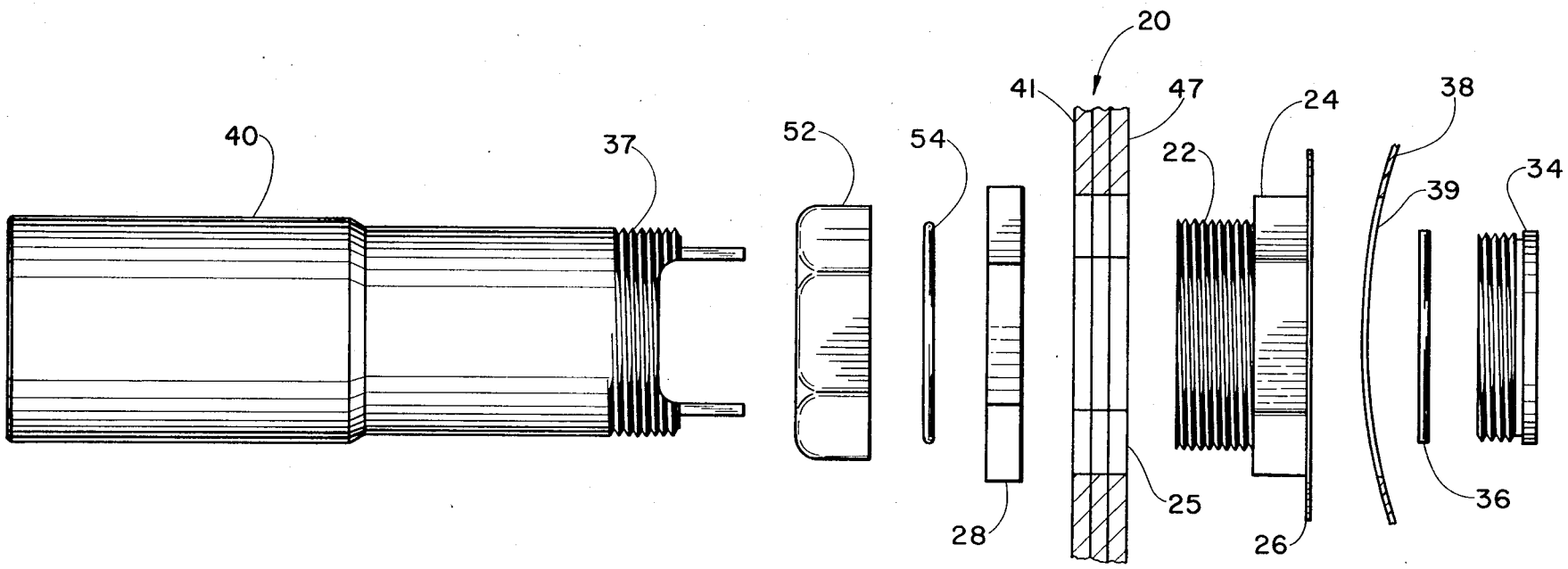
FIG. 7 is an exploded view illustrating the parts of a fitment of a preferred embodiment of the invention and the location of the parts relative to the fibreboard container and bag.

The bung 34 may have various shapes and, as shown in the embodiment of FIGS. 1, 6, and 7 the bung 34 is provided with a central tubular portion threaded on its outer surface for engagement with the internal threads 23 of the tubular spout and hexagonal flange.

Outer threads 37, can be provided on the outer diametrical surface 51 of valve tube 40, as shown in FIG. 7, which engage the inner threads 23 of the tubular spout 22 after or coincidental with the insertion of the prongs 48 into the recesses 50 to allow for a positive threaded interconnection of the valve tube 40 and the drain spout assembly. Alternatively, the outer threads 37 can be positioned on the smaller diametrical surface 51 adjacent to the transition to the larger diametrical surface. In such case, a shoulder (not shown) having a female thread would be formed on the aft section of the coupler 52 for engagement with the outer threads 37.

The fitment, as disclosed herein, is preferably constructed from injection molded plastic parts.

It will be apparent to those skilled in the art that changes may be made to the described embodiments without departing from the scope of the invention. For example, a plastic liner may be used within the fibreboard container as the plastic retainer member for retaining the bulk flowables in lieu of a plastic bag 38. The annular flange 26 is preferably located between the plastic retainer member and the fibreboard wall to preclude abrasion of the liner due to rubbing against the wall which could occur during transport of a loaded container. Though less preferable, the annular flange 26 could be sealed to the side of the plastic liner member which is remote from the inner wall surface 47 of the fibreboard container 20. The bag or liner may alternatively comprise two or more plies, in which case, one or more of the plies can be fixed to opposite sides of the annular flange 26. To facilitate construction of the valve tube 40, the tubular portion thereof and prongs 48 may be fabricated from separate plastic parts adhesively joined together. The drain spout fitment assembly of the invention is useable with double-wall and quadruple-wall corrugated fibreboard side walls of containers. In addition, for heavier gross weights, the fitment assembly may be utilized in connection with bag-in-box containers provided with a full-depth multi-wall corrugated liner between the outer multi-wall fibreboard sleeve and the inner plastic member (bag or liner) which retains the flowables contained in the container. In addition, it will be apparent that the tubular spout 22 could extend through the shell opening 25 and be attached directly to the annular flange with the hexagonal flange 24 circumscribing the tubular spout within the opening 25.

In invention claimed is:

1. In a bulk container of the type having a side wall of multi-wall fibreboard with a side wall opening extending therethrough from an inner wall surface to an outer wall surface, and a plastic retainer member supportedly mounted within the container for retaining the bulk flowables, the plastic member having a drain opening extended there through in registry with the side wall opening for passing the flowables driven by gravity flow from the container from within the plastic member through the drain opening and side wall opening, an improved push/turn tap and drain spout fitment assembly, in combination therewith, comprising:

a drain spout assembly including an annular flange sealed to the plastic member about the drain opening, spout means in fluid communication with the drain opening for establishing a discharge flow path through the side wall opening, and a polygonal flange having a polygonal cross-section interconnected between the spout means and the annular flange and operatively engaged to the multi-wall fibreboard within the side wall opening for restraining rotation of the spout means relative to the plastic retainer member, the spout means comprising a spout tube extended outwardly of the container, the spout tube including a threaded outer surface and a threaded inner surface, a nut threadably engaged to the outer surface of the spout tube in abutment with the outer wall surface of the side wall for holding the annular flange against the inner wall surface of the side wall;

a closure member removably mounted to the drain spout assembly for closing the flow path in a first position and opening the flow path in a second position;

a tubular member mounted in the discharge flow path and having a portion designed for reception in the closure member and including means, outside of the container, such that the tubular member may be gripped for translating movement of the portion into engagement with the closure member and into rotary movement of the closure member from the first position to the second position; and coupling means for coupling the tubular member to the spout tube outer surface;

2. An improved combination as recited in claim 1 wherein the side wall opening comprises a polygonal cross-section, the polygonal flange being received within the side wall opening tightly fitted against the fibreboard side wall.

3. An improved combination as recited in claim 2 wherein the polygonal cross-section of the side wall opening and the polygonal cross-section of the polygonal flange are complementary.

4. An improved combination as recited in claim 2 wherein each of the side wall opening and the polygonal flange has a hexagonal cross-section.

5. An improved combination as recited in claim 1 wherein the annular flange is mounted intermediate the side wall and the plastic retainer member.

6. An improved combination as recited in claim 1 further comprising means for sealing and frictionally engaging the coupling means to the tubular member.

7. An improved combination as recited in claim 6 wherein the portion of the tubular member designed for reception in the closure member comprises a plurality of prongs projecting from the tubular member, and wherein the closure member comprises a bung threadably engaged to the drain spout assembly, the bung including a plurality of recesses for receiving the prongs.

8. An improved combination as recited in claim 7 wherein the tubular member includes a circular end, each of the prongs being mounted to the circular end at circumferentially spaced intervals relative to each other to form apertures therebetween through which the flowables may flow as the closure member is moved from the first position to the second position.

9. A fitment for a bulk container of the type having a side wall of multi-wall fibreboard with a side wall opening extending there through from an inner wall surface to an outer wall surface, and a plastic retainer member supportedly mounted within the container for retaining the bulk flowables, the plastic member having a drain opening extended there through in registry with the side wall opening for passing the flowables driven by gravity flow from the container from within the plastic member through the drain opening and side wall opening, the fitment comprising:

a drain spout assembly including an annular flange sealed to the plastic member about the drain opening, spout means in fluid communication with the drain opening for establishing a discharge flow path through the side wall opening, and restraining means operatively engaged to the multi-wall fibreboard within the side wall opening for restraining rotation of the spout means relative to the plastic retainer member, the spout means comprising a spout tube extended outwardly of the container, the spout tube including a threaded outer surface and a threaded inner surface, a nut threadably engaged to the outer surface of the spout tube in abutment with the outer wall surface of the side wall for holding the annular flange against the inner wall surface of the side wall;

a closure member removably mounted to the drain spout assembly for closing the flow path in a first position and opening the flow path in a second position;

a tubular member mounted in the discharge flow path and having a portion designed for reception in the closure member and including means, outside of the container, such that the tubular member may be gripped for translating movement of the portion into engagement with the closure member and into rotary movement of the closure member from the first position to the second position; and coupling means for coupling the tubular member of the spout tube outer surface.

10. A fitment as recited in claim 9 wherein the restraining means comprises a polygonal flange having a polgonal cross-section interconnected between the spool means and the annular flange.

11. A fitment as recited in claim 9 wherein the portion of the tubular member designed for reception in the closure member comprises a plurality of prongs projecting from the tubular member, and wherein the closure member comprises a bung threadably engaged to the drain spout assembly, the bung including a plurality of recesses for receiving the prongs.

12. A fitment as recited in claim 11 further comprising means for sealing and frictionally engaging the coupling means to the tubular member.

13. A fitment as recited in claim 12 wherein the restraining means comprises a polygonal flange having a polygonal cross-section interconnected between the spout means and the annular flange.

* * * * *